United States Patent [19]

DeLaurentis et al.

[11] 4,200,854

[45] Apr. 29, 1980

[54] CORE WITH STEP-LAP JOINTS

[75] Inventors: Angelo A. DeLaurentis, Sharpsville; Frank G. Zola, Jr.; Theodore R. Specht, both of Sharon, all of Pa.

[73] Assignee: Westinghouse Electric Corp., Pittsburgh, Pa.

[21] Appl. No.: 933

[22] Filed: Jan. 4, 1979

[51] Int. Cl.[2] ..... H01F 27/24

[52] U.S. Cl. ..... 336/217; 29/606

[58] Field of Search ..... 336/216, 217, 234, 233; 29/606, 607, 609

[56] References Cited

U.S. PATENT DOCUMENTS

| | | | |
|---|---|---|---|
| 3,153,215 | 10/1964 | Burkhardt et al. | 336/217 |
| 3,210,709 | 10/1965 | Ellis et al. | 336/217 |
| 3,477,053 | 11/1969 | Burkhardt et al. | 336/217 X |
| 3,504,318 | 3/1970 | Wilburn et al. | 336/217 X |
| 3,540,120 | 11/1970 | DeLaurentis et al. | 29/609 |
| 3,559,136 | 1/1971 | Specht et al. | 336/217 |
| 3,611,234 | 10/1971 | DeLaurentis et al. | 336/217 |
| 3,670,279 | 6/1972 | Millsop et al. | 336/217 |
| 3,743,991 | 7/1973 | Gumpper et al. | 336/217 |
| 3,895,336 | 7/1975 | Pitman | 336/217 |
| 3,918,153 | 11/1975 | Burkhardt et al. | 336/217 X |

*Primary Examiner*—Thomas J. Kozma
*Attorney, Agent, or Firm*—D. R. Lackey

[57] ABSTRACT

New and improved magnetic cores for electrical inductive apparatus, and new and improved methods of constructing electrical apparatus, which facilitate the manufacture of such apparatus. The new and improved magnetic cores are of the stacked type, and they utilize different step-lap joints between selected yoke and leg members of the magnetic core. The new and improved methods include the steps of prestacking the leg members, stacking the bottom yoke member while the legs are substantially horizontally oriented, starting at one side of the leg members and progressing to the other side, and stacking the upper yoke member while the legs are substantially vertically oriented, starting from substantially the midpoints of the leg members and progressing outwardly in opposite directions.

16 Claims, 17 Drawing Figures

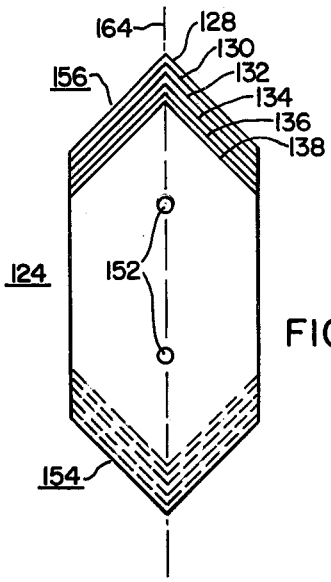
FIG. 4A.
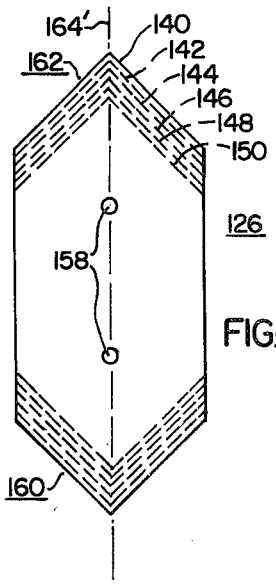
FIG. 4B.
FIG. 5.
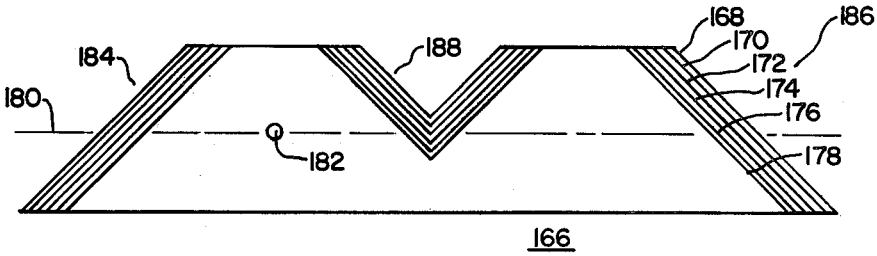
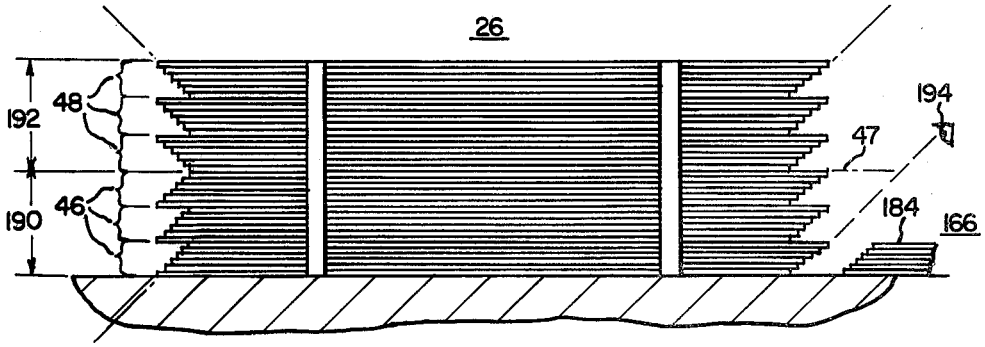
FIG. 6.

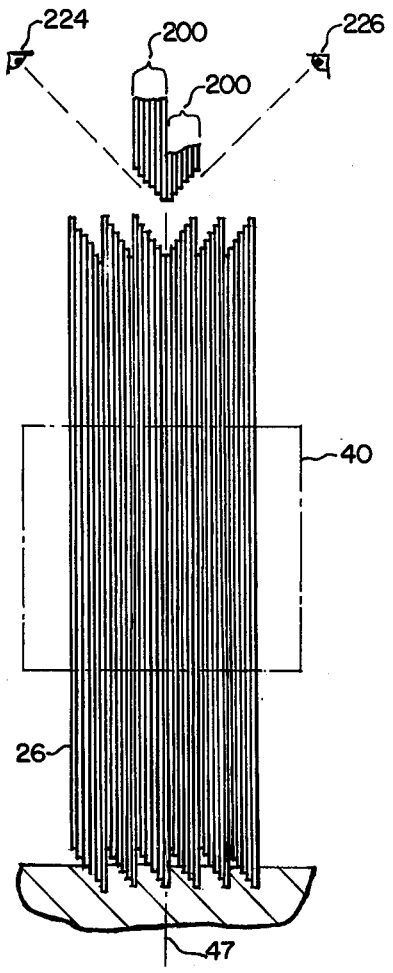
FIG. 9.
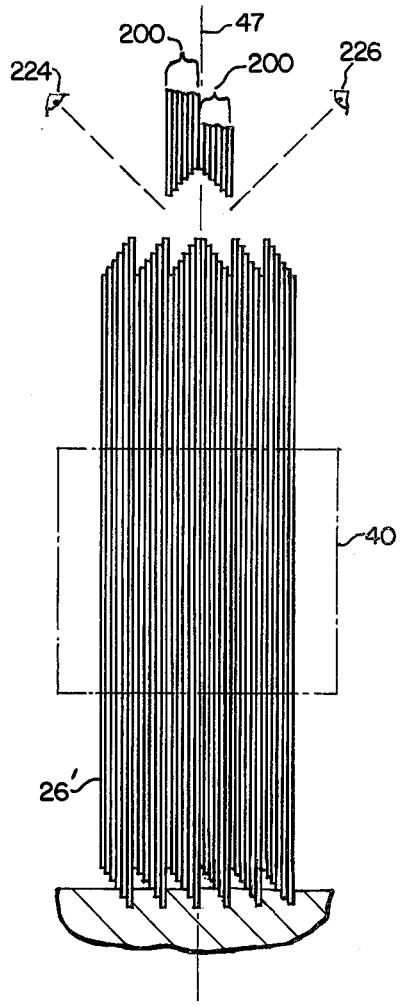
FIG. 12.
FIG. 11.
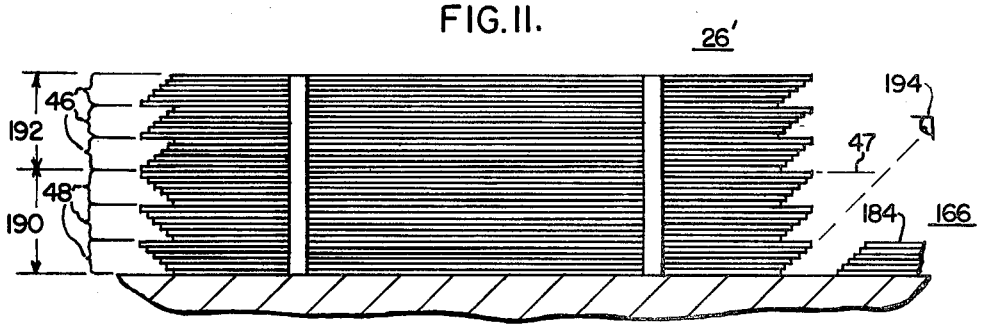

CORE WITH STEP-LAP JOINTS

BACKGROUND OF THE INVENTION

1. Field of the Invention

The invention relates to electrical inductive apparatus, including new and improved magnetic core structures, and new and improved methods of constructing electrical inductive apparatus.

2. Description of the Prior Art

Stacked magnetic cores for large electrical power transformers of the core-form type conventionally use the butt-lap type of joint disclosed in U.S. Pat. No. 2,300,964. In the butt-lap joint the ends of the leg and yoke laminations are mitered and butted together to form diagonal joints between the laminations, in each layer of laminations. In principle, the joints in alternate layers are aligned, and offset from aligned joints in the intervening layers. In practice, to reduce handling, the joints in three adjacent layers of laminations are usually aligned, and the joints in the next three adjacent layers are aligned, but offset from the joints of the adjacent group of three laminations.

While the butt-lap construction can form a good magnetic circuit, it has disadvantages. One is the great care with which laminations must be stacked in order to optimize magnetic performance. Another disadvantage is the amount of power loss at the joints (true watts loss or T.W.), which increases the excitation current required (apparent watts loss or A.W.), and increases the sound level.

A step-lap joint, such as disclosed in U.S. Pat. No. 3,153,215, reduces core losses, it reduces the excitation current requirements, and it reduces the sound level, compared with a similarly rated transformer constructed with a butt-lap joint. In a step-lap joint, the joints created by the butting laminations of each layer are successively offset in succeeding layers in the same direction to create at least three "steps", and preferably at least six or seven, before the step pattern is repeated.

In the step-lap joint, induction (flux lines per unit area) is only a fraction of that in the laminations leading to the joint, as the flux spreads out where it crosses the lap portion of the joint. A butt-lap joint, in contrast, has about twice as much induction at the joint as in the laminations leading to the joint, as the flux lines crowd where the air gaps are bridged. In the butt-lap joint, eddy currents representing lost energy are generated by flux, at high induction, crossing several laminations. Eddy currents generated by flux of such orientation are restricted only by the relatively large area of the plane of the steel sheet, rather than by the small sheet thickness.

Thus, reluctance of the step-lap joint is much lower than that of the butt-lap joint, the core losses are lower, and the no-load excitation current required for a core with step-lap joints is considerably less than that for a butt-lap core. The result is achievement of a given performance level with greater efficiency and smaller unit size. Sound level is less because the much lower induction at the joints results in less "motor-action" vibration at the joints.

While the step-lap core has all of the above-mentioned advantages in true watts loss (TW), apparent watts loss (AW), and sound level, the step-lap joint has primarily been applied to the lower power ratings of core-form construction where the winding leg is rectangular in cross sectional configuration, and the windings are substantially rectangular in cross sectional configuration. The larger KVA core-form power transformers conventionally utilize round coils and cruciform core-leg cross sectional configurations. The butt-lap joint has been retained in this type of construction because the manufacturing cost of constructing the step-lap joint in a cruciform core offset the advantages to be gained.

Thus, it would be desirable to provide a new and improved step-lap core, and new and improved methods of constructing electrical inductive apparatus which utilize a step-lap core, to facilitate the manufacture thereof such that the advantages of the step-lap core are not offset by higher assembly costs.

SUMMARY OF THE INVENTION

Briefly, the present invention is a new and improved magnetic core of the stacked type, having upper and lower yoke members, and leg members interconnected by step-lap joints. Different step-lap patterns are utilized in the same magnetic core, to produce step-lap joints between the leg members and the upper yoke member which change at substantially the midpoint of the build dimension. On the other hand, the step-lap joints between the leg members and the lower yoke member repeat without change across the complete build of the core.

New and improved methods of constructing electrical inductive apparatus, such as a power transformer of the core-form type, include the step of prestacking the leg members of the magnetic core. Such prestacking may conveniently be accomplished with an automatic shear line. The width of the metallic, magnetic sheet material, i.e., electrical steel, of which the laminations are to be cut, may be changed such that the leg members may be pre-stacked to provide a cruciform cross sectional configuration in order to accommodate the round coil construction of large power transformers.

The pre-stacked legs for a specific magnetic core are substantially horizontally oriented and the lower yoke member is manually stacked. Th leg laminations and the pre-stacking procedure for the leg members are selected to produce a step-lap joint profile between the lower yoke member and the leg members which repeats without change across the complete build of the magnetic core. The step-lap joints selected for the lower yoke member and joining leg members preferably expose the steps of the lower yoke laminations to the assembler, assuring good joint closure and easy checking of the joint. Thus, the lower yoke is assembled from one side of the core build to the other, with the assembler preferably handling a group of pre-stacked yoke laminations at a time, such as all of the yoke laminations of the basic step-lap pattern.

The resulting subassembly of the lower yoke member and leg members is then uprighted to enable winding assemblies to be telescoped over the free, upstanding ends of the leg members. The upper yoke member is then manually stacked while the leg members are substantially vertically oriented.

The leg laminations and the pre-stacking procedure for the leg members are selected to produce a step-lap profile between the upper yoke member and the leg members which is different in different halves of the core build. The profile changes at the midpoint of the core build such that, when viewed from either side of the magnetic core, the step-lap joint to the midpoint of the core build appears to be the same joint. In other words, the two different step-lap patterns in the upper yoke member are in 180° rotational symmetry with each other, about a vertical central axis of the magnetic core. The upper yoke laminations are stacked, starting at the midpoint of the build dimension of the pre-stacked leg members, with the stacking progressing outwardly in opposite directions. Thus, the two halves of the upper yoke member may be stacked simultaneously. The step-lap pattern between the upper yoke member and the leg members may be selected to expose the steps on the yoke laminations to the assembler, or to expose the steps of the leg laminatons to be assmbler, as desired. Similar to the stacking of the lower yoke member, the assembler handles several preoriented laminations at a time, such as all of the laminations of a basic step-lap pattern.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIGS. 4A and 4B illustrate different stepped groups of leg laminations used in the lower and upper halves, respectively, of the build dimension, of an inner leg member of a magnetic core;

FIG. 5 illustrates a stepped group of lower yoke laminations which is used to complete step-lap joints with the leg laminations of FIGS. 2A, 2B, 3A, 3B, 4A and 4B;

FIG. 6 is a side elevational view of leg laminations shown in FIGS. 2A and 2B stacked in superposed relation to define a pre-stacked outer leg member, and a fragmentary view of the group of lower yoke laminations shown in FIG. 5, during an assembly step according to the teachings of the invention;

FIG. 9 is a side elevational view of the assembly shown in FIG. 7, and a fragmentary view of two groups of the upper yoke laminations shown in FIG. 8, illustrating steps in the assembly of electrical inductive apparatus according to the teachings of the invention;

FIG. 11 is a view similar to that of FIG. 6, except the upper and lower halves of the leg members are reversed in relative positions, illustrating that the bottom yoking step is unchanged by this change in orientation;

FIG. 12 is a view similar to that of FIG. 9, except the upper and lower halves of the leg members are as shown in FIG. 11, illustrating that the profiles of the step-lap configuration have been changed, compared with the FIG. 9 embodiment;

DESCRIPTION OF THE PREFERRED EMBODIMENT

Figure 1:
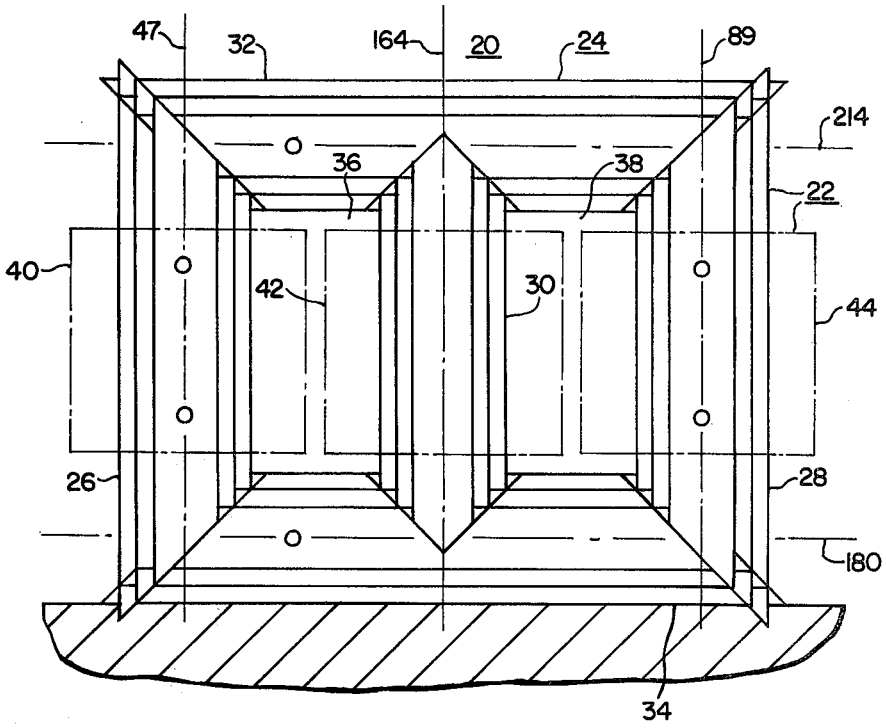
FIG. 1 is an elevational view of electrical inductive apparatus which includes a three-phase magnetic core having upper and lower yoke members, outer leg members, and an inner leg member, which may be constructed according to the teachings of the invention.

Referring now to the drawings, and to FIG. 1 in particular, there is shown an elevational view of electrical inductive apparatus 20 which may be constructed according to the teachings of the invention. Apparatus 20 includes a three-phase magnetic core-winding assembly 22 of the core-form type, having a magnetic core 24 and a plurality of phase winding assemblies shown in phantom. Magnetic core 24 includes first and second outer leg members 26 and 28, respectively, an inner leg member 30, and upper and lower yoke members 32 and 34, respectively. Magnetic core 24 is of the stacked type, with each of the leg and yoke members being constructed of a stack of metallic, magnetic laminations, such as grain oriented silicon steel. Magnetic core 24 thus has a plurality of superposed layers of metallic punching or laminations, with the ends of the various laminations of each layer being cut or sheared diagonally, and butted together to define closed magnetic loops or circuits about openings or windows through which the windings pass.

While the invention applies equally to rectangular or round coil construction, in which the cross sectional configuration of the winding legs is rectangular and cruciform, respectively, the magnetic core 24 is illustrated as being of the cruciform type in FIG. 1. Thus, magnetic strip material of different widths, such as three different widths, is cut to form the laminations for the various layers of the core. The remaining figures do not illustrate the cruciform type core, in order to limit the complexity of the drawings, and to more clearly illustrate the teachings of the invention.

The magnetic core-winding assembly 22 includes phase winding assemblies 40, 42, and 44 disposed about leg portions 26, 30 and 28, respectively, with each phase winding assembly including the primary and secondary windings of an electrical power transformer, for example. While the magnetic core-winding assembly 22 is illustrated as being three-phase, it is to be understood that the invention applies equally to single-phase core-form construction, in which the inner leg would be eliminated.

Magnetic core 24 is of the step-lap type, with the joints between the leg and yoke members being incrementally offset from layer-to-layer in a predetermined stepped pattern. The joints between the outer leg members 26 and 28 and the upper and lower yoke members 32 and 34 are mitered, preferably at an angle of 45° with respect to the side edges of the laminations, with the miter joint in each layer of laminations being offset from layer-to-layer to create the desired step-lap pattern. The joints between the inner leg members 30 and upper and lower yoke members are also step-lap joints, with the ends of the laminations of the inner leg members being V-shaped. The yoke laminations have V-shaped notches dimensioned to complement the V-shaped end of the inner leg lamination of its layer, to provide low loss diagonal joints. As will be hereinafter explained, the step-lap joints at the inner leg are "vertical" step-lap joints which change the penetration of the leg into the yoke lamination, instead of "horizontal" step-lap joints, in which the penetration is maintained constant.

The step-lap pattern steps incrementally in one direction for a predetermined number of steps and then returns to the starting point to repeat the same pattern. The laminations which are required to complete a basic step-lap pattern are called a group, with a plurality of groups being superposed until the desired build dimension is achieved. To qualify as a step-lap pattern, the pattern must have at least three steps, but better results from the standpoint of T. W., A. W. and noise are obtained when using more than three steps. Six or seven steps have been found to be excellent, and the magnetic core of the invention will be described as having six steps, for purposes of example. A suitable step increment, measured perpendicular to the diagonally cut edge is about 0.200 inch.

While a six step pattern is preferably constructed using a group of six laminations, the invention also applies to having more than one lamination per step. The best overall performance is achieved with one lamination per step, but manufacturing considerations sometimes make it desirable to have more than one lamination per step. For example, a six step pattern with two similar superposed laminations per step would have 12 laminations per group.

The invention relates to new and improved magnetic cores, which may be used for the magnetic core 24 shown in FIG. 1, and new and improved methods of constructing electrical inductive apparatus, such as the electrical inductive apparatus 20 shown in FIG. 1. Methods of constructing electrical apparatus according to the invention will now be described, with the structure of new magnetic cores, which may be used in the new methods, being concurrently described.

Figure 2A:
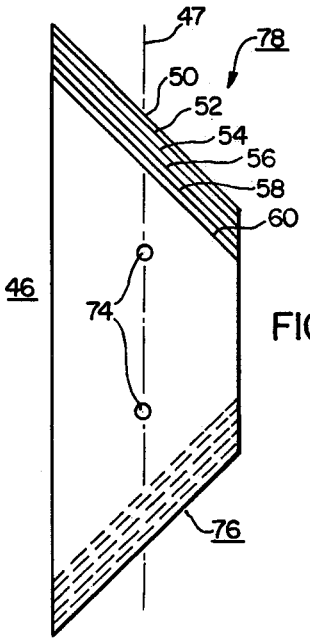
FIGS. 2A and 2B illustrate different stepped groups of leg laminations used in the lower and upper halves, respectively, of the build dimension, of one of the outer leg members of a magnetic core.
Figure 2B:
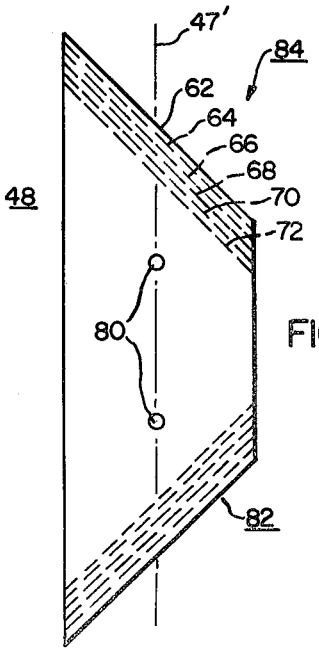

More specifically, FIGS. 2A and 2B illustrate first and second groups 46 and 48, respectively, of outer leg laminations having first and second diagonally cut ends which may be used to form the first outer leg member 26 of magnetic core 24 shown in FIG. 1. The first ends of the leg laminations shown in FIGS. 2A and 2B, and also the first ends of the leg laminations in the remaining figures, are those which are coupled with the lower yoke member, and are those illustrated at the lower end of the figures. The remaining or second ends are those which are coupled with the upper yoke member, and they appear at the upper ends of the figures.

The first group 46 includes six leg laminations 50, 52, 54, 56, 58 and 60 having like mean length dimensons, measured along a longitudinal axis 47 of the group, and the second group 48 includes six leg laminations 62, 64, 66, 68, 70 and 72 having unlike mean length dimensions, measured along a longitudinal axis 47' of the group. The term "mean length" is used instead of simply the term length dimension, because incremental clipping of the ends of otherwise like length laminations is sometimes used in the prior art to facilitate the arrangement of the diagonally cut ends of the laminations into a stepped pattern. Instead of saying that the mean length dimensions of the laminations of the first group 46 are the same, it would also be suitable to say that the laminations are cut from a strip of magnetic material to form a trapezoidal configuration, with the shorter of the parallel sides of the trapezoidal configuration all having the same dimension.

Referring now specifically to FIG. 2A, in the illustrated embodiment of the invention holes 74 are provided in each lamination, and the holes are incrementally offset such that when they are aligned the midpoints of the equal length laminations are incrementally offset. Thus, the diagonally cut ends of the laminations provide a first step configuration 76 at the first ends of the laminations, and a second step configuration 78 at the second ends of the laminations. Holes are preferred over clipped ends when the step pattern crosses the geometric corner of the magnetic core, as clips would have to be provided on the first ends of some laminations, and on the second ends of other laminations, in the same group. Stepping the pattern around the corner is preferred, in order to divide the void volume created at the inner corners between the leg and yoke members. It will be noted that offsetting the midpoints of equal length laminations produces stepped configurations 76 and 78 which appear on opposite sides of the group 46, with the stepped configuration 76 being concealed and the stepped configuration 78 being exposed, in the orientation of group 46 shown in FIG. 2A.

Referring now to FIG. 2B, holes 80 are provided in the laminations such that when like positioned holes are aligned, the midpoints of the unequal length laminations of group 48 are aligned. This arranges the diagonally cut ends of the laminations of group 48 in a first stepped configuration 82 at the first ends of the laminations, and in a second stepped configuration 84 at the second ends of the laminations. It will noted that aligning the midpoints of laminations of unequal lengths, which laminations are arranged in the order of their lengths, produces stepped configurations 82 and 84 at their diagonally cut ends which appear on the same side of the group 48, with both stepped configurations 82 and 84 being concealed in the orientation of group 48 shown in FIG. 2B.

It should also be noted that the step configuration 76 at the first ends of the laminations of group 46 is the same as the step configuration 82 at the first ends of the laminations of group 48. In other words they are both concealed in the illustrated orientation of groups 46 and 48. On the other hand, the step configurations 78 and 84 at the second ends of the laminations of groups 46 and 48, respectively, are unlike. In other words, they are on different sides of their respective groups, in the orientation of the groups shown in FIGS. 2A and 2B.

In the construction of an outer leg member 26 from groups 46 and 48 shown in FIGS. 2A and 2B, one half of the build dimension of the leg member is formed by repeating one of these groups, and the remaining one half is formed by repeating the other of the groups. In a preferred embodiment of the invention, the outer leg member 26 is constructed by horizontally stacking groups 46 up to the midpoint of the final desired build dimension, and then groups 48 are stacked, one on top of the other, until the build dimension has been completed.

In a new and improved method of constructing electrical inductive apparatus, the leg members are each pre-stacked and banded to maintain the integrity of the stack. If an automatic shear line is used, for example, the shear would be programmed to cut all of the laminations of each layer, and then all of the laminations of the next layer etc., depositing laminations for like core members on the same stack, over upstanding posts which enter the holes in the laminations to automatically create the stepped configurations at the ends of the stacked laminations. Thus, in the construction of outer leg member 26, the laminations would first be cut to same length, while incrementing the position of the holes 74. After a predetermined number of groups 46 are created and stacked, the shear line would then start incrementally changing the length of the laminations for leg member 26, while maintaining the positions of the holes in the same positions in each of these different length laminations, relative to the midpoints of the laminations. When the remaining half of the build dimension has been completed, the stack is banded and ready for the yoking operation. With a cruciform core, of course, the width of the strip material would be changed when appropriate to create the cruciform cross sectional configuration of the core leg member. FIG. 6, which will be hereinafter described in detail, illustrates an elevational view, a pre-stacked and banded outer leg member 26, with the longitudinal axis 47 horizontally oriented.

Figure 3A:
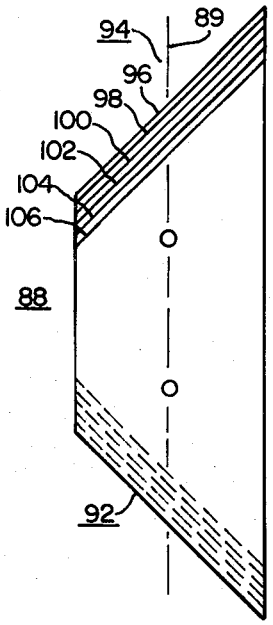
FIGS. 3A and 3B illustrate different stepped groups of leg laminations used in the lower and upper halves, respectively, of the build dimension of another of the outer leg members of a magnetic core.
Figure 3B:
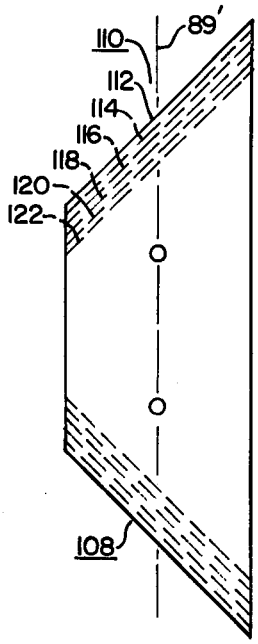

FIGS. 3A and 3B illustrate first and second groups 88 and 90, respectively, of outer leg laminations which may be used to form the second outer leg member 28 of magnetic core 24 shown in FIG. 1. Group 88 has first and second stepped configurations 92 and 94 at the first and second ends of like length laminations, measured along the longitudinal axis 89, and group 90 has first and second stepped configurations 108 and 110 at the first and second ends of unlike length laminations, measured along the longitudinal axis 89'.

Except for the orientation of the groups, group 88 of FIG. 3A is the same as group 46 of FIG. 2A, and group 90 of FIG. 3B is the same as group 48 of FIG. 2B. Thus, it is unnecessary to describe the construction of the second outer leg member 28 in detail. It is sufficient to say that one half of the build dimension of the second outer leg member 28 is constructed by repeating one of the groups, and the other half by repeating the other of the groups. In the preferred embodiment, groups 88 would occupy the lower half of the leg member, as stacked, and groups 90 would occupy the upper half. Note that the stepped configurations 92 and 108 at the first ends of the laminations are concealed, and that the stepped configurations 94 and 110 at the second ends are exposed and concealed, respectively, in the same manner as the stepped configurations of groups 46 and 48.

FIGS 4A and 4B illustrate first and second groups 124 and 126, respectively, of inner leg laminations having first and second V-shaped ends, which may be used to form the inner leg member 30 of magnetic core 24 shown in FIG. 1. The first group 124 includes six inner leg laminations 128, 130, 132, 134, 136 and 138 having like length dimensions, measured along a longitudinal axis 164, and the second group 126 includes six inner leg laminations 140, 142, 144, 146, 148 and 150 having unlike length dimensions. Holes 152 in the laminations of group 124 are aligned to provide first and second stepped configurations 154 and 156, respectively, at the first and second ends, respectively, of the like length laminations. It should be noted that the stepped configurations 154 and 156 are hidden and exposed, respectively, in the orientation of group 124 shown in FIG. 4A, and that the ends of the laminations are incrementally offset in a vertical direction relative to the illustrated orientation. In other words, they are offset along the longitudinal axis 164 of the group, as opposed to being offset in a direction perpendicular to the longitudinal axis.

Holes 158 in the laminations of group 126 shown in FIG. 4B are aligned to provide first and second stepped configurations 160 and 162 at the first and second ends, respectively, of unlike length laminations. Stepped configurations 160 and 162 are both concealed, in the orientation of group 126 shown in FIG. 4B, with the ends of the laminations being incrementally offset along the longitudinal axis 164' of the group.

Groups 124 are superposed to form one half of the build dimension of the inner leg member 30, and groups 126 are superposed to form the remaining one half. In the preferred embodiment of the invention, group 124 is used to form the lower one half of the leg member, as stacked, and group 126 is used to form the upper one half. It will be noted that the stepped configurations 154 and 160 at the first ends of groups 124 and 126, respectively, are concealed in the illustrated orientation, while the stepped configuration 156 at the second ends of the laminations of group 124 is exposed, and the stepped configuration 162 at the second ends of the laminations of group 126 are concealed.

FIG. 5 is a plan view, as stacked, of a group 166 of lower yoke laminations 168, 170, 172, 174, 176 and 178, which may be used to form the lower yoke member 34 of magnetic core 24 shown in FIG. 1. The laminations of group 166 have diagonally cut ends, and unlike mean lengths, as measured along the longitudinal axis 180 of the group. The laminations of group 166 may be aligned when cut and stacked via a hole in each lamination, such as hole 182. Hole 182 would occupy the same position in each lamination, relative to the midpoint of the lamination, which creates stepped configurations 184 and 186 at the diagonally cut ends of the laminations. Each lamination of the group has a V-shaped notch cut in the short side of its trapezoidal configuration, with the notches being vertically incremented, i.e., perpendicular to the longitudinal axis 180 of the group, from lamination to lamination, to create stepped configuration 188. It should be noted that the stepped configurations 184, 186 and 188 are all located on the same side of group 166, and all are exposed, in the orientation of group 166 shown in FIG. 5. The groups 166 of lower yoke laminations are used all the way through the build of the magnetic core, with a like orientation. However, unlike the leg members, the stack of yoke laminations is not banded, as they are manually stacked a few laminations at a time into the prestacked and banded leg members. If the complete group 166 is not too heavy, the lower yoke member is preferably stacked a group at a time. Otherwise, fewer yoke laminations may be stacked at a time.

The next step in the method of constructing electrical inductive apparatus according to the teachings of the invention is to place the pre-stacked and banded leg members in spaced, side-by-side relation on a building table, such that the longitudinal axes 47, 164 and 89 of leg members 26, 30 and 28, respectively, are parallel and in a common, substantially horizontal, plane. Thus, a side elevational view of this arrangement, viewing the long sides of the trapezoidal configuration of the laminations of group 46 and 48 which make up the outer leg member 26, would appear substantially as shown in FIG. 6. The lower on half of leg member 36, represented by dimension 190, is constructed of a plurality of groups 46, and the upper one half, represented by dimension 192, is constructed of a plurality of groups 48. The uppermost lamination of each of the groups 46 and 48 conceals the ends of the other laminations of the group from an assembler in the position of "eye" 194. However, the stepped configurations 184 and 186 at the ends of the lower yoke laminations, and the stepped configuration 188 at the midpoint of one side of the lower yoke laminations, are visible to the assembler. This of critical importance when assembling the laminations with their flat major opposed surfaces oriented in substantially horizontal planes, as it enables the assembler to look into the closing joint, as the group 166 of lower yoke laminations is advanced into position. A good tight butt joint between each of the adjoining laminations of a layer is essential in order to obtain optimum magnetic characteristics and the lowest sound level. The disclosed stacking arrangement promotes good joint closure, and it permits joint closure to be quickly checked. A group 166 of lower yoke laminations is advanced into position, as shown in FIG. 6, to create step-lap joints between the lower yoke member and the leg members. The stacking of the lower yoke thus starts at one side of the pre-stacked leg members, and it advances to the other side. The bottom yoke bundle of laminations is turned over before starting the stacking step, in order that the assembler will use the lamination cut with the corresponding layer of leg laminations. Thus, slight variations in gauge of the strip material with not be a problem, as the laminations for each layer of laminations will be those which have been sequentially cut from the same strip of magnetic material.

Figure 7:
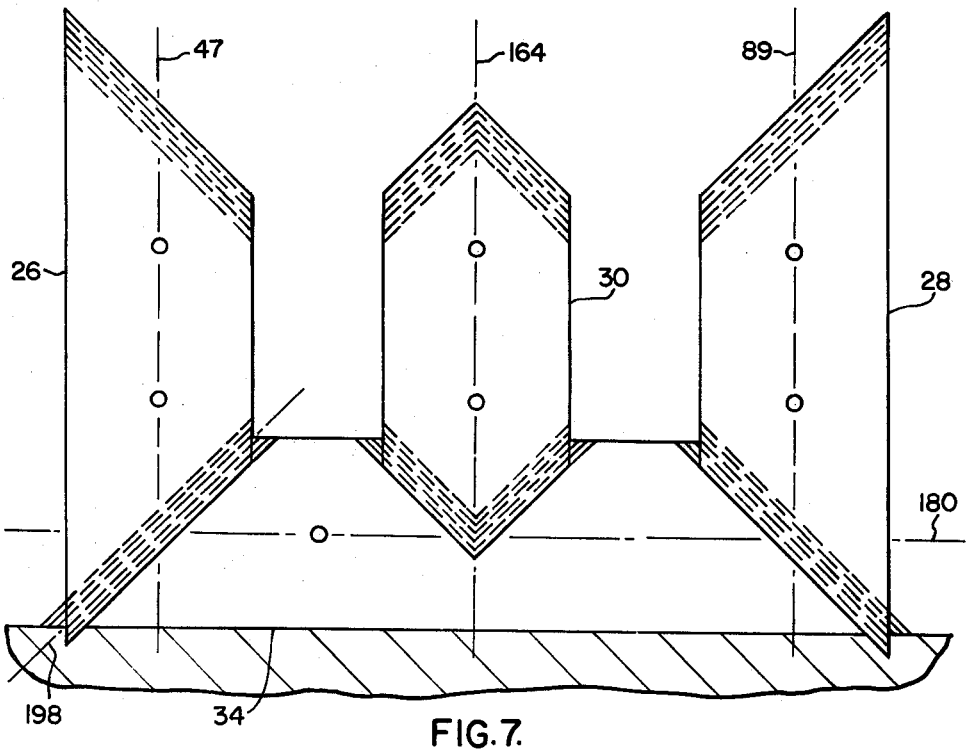
FIG. 7 illustrates the lower yoke member after assembly with the outer leg members and inner leg member, to provide a subassembly, and after uprighting of the subassembly just prior to the step of assembling the phase windings and upper yoke member.

After the lower yoke member 34 has been stacked and suitably clamped in bottom end frames (not shown), the next step is to upright the resulting subassembly, as shown in FIG. 7. The lower yoke member 34 is at the bottom of the uprighted subassembly, and the leg members 26, 28 and 30 extend vertically upward from the lower yoke member 34. It will be noted that the step-lap pattern is equally distributed on both sides of each geometrical corner of the magnetic core, such as the corner 198 between the lower yoke member 34 and the first outer leg member 26.

Figure 10:
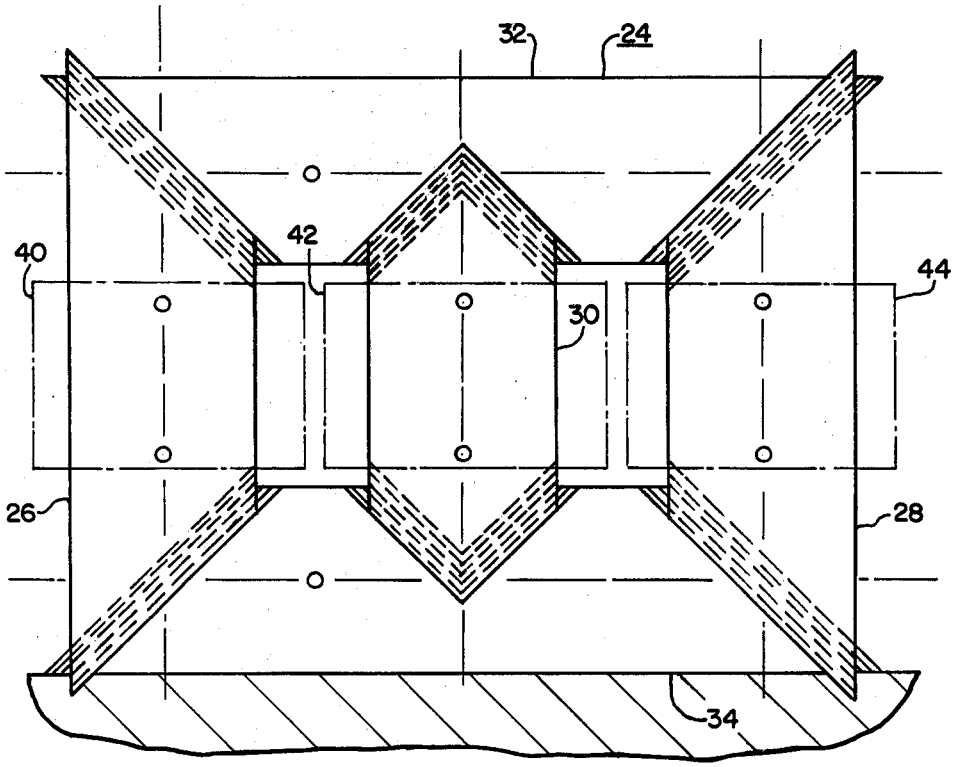
FIG. 10 is an elevational view of electrical inductive apparatus constructed according to the teachings of the invention, illustrating the apparatus following the yoking step shown in FIG. 9.

The next step is to telescope the phase winding assemblies 40, 42 and 44 over the upstanding leg members 26, 28 and 30, respectively, such as shown in FIGS. 1, 9 and 10. After the phase winding assemblies are in place, the upper yoke member 32 is stacked.

Figure 8:
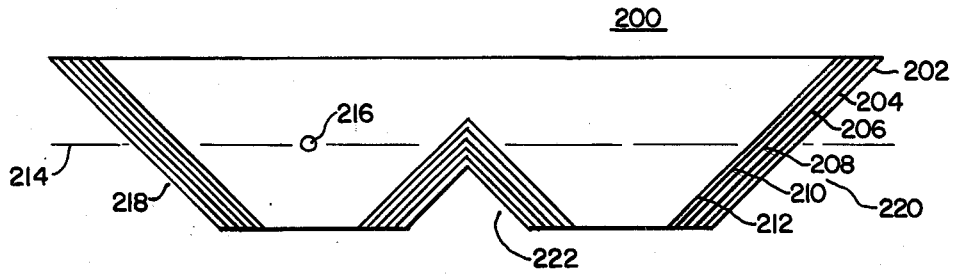
FIG. 8 illustrates a stepped group of upper yoke laminations which is used to complete step-lap joints with the leg laminations of FIGS. 2A, 2B, 3A, 3B, 4A and 4B.

FIG. 8 is a plan view, as stacked, of a group 200 of upper yoke laminations 202, 204, 206, 208, 210 and 212 which may be used to form the upper yoke member 32 of magnetic core 24 shown in FIG. 1. The laminations of group 200 have diagonally cut ends, and unlike mean lengths, measured along a longitudinal axis 214 of the group. The laminations of group 200 may be aligned when cut and stacked via a hole in each lamination, such as hole 216. Hole 216 would occupy the same position in each lamination, relative to midpoint of the lamination, which creates stepped configurations 218 and 220 at the diagonally cut ends of the laminations. Each lamination of the group has a V-shaped notch cut in the short side of its trapezoidal configuration, with the notches being vertically incremented perpendicular to the longitudinal axis 214 of the group, from lamination to lamination, to create stepped configuration 222. It should be noted that the stepped configurations 218, 220, and 222 are all located on the same side of group 200, in the orientation of group 200 shown in FIG. 8. It should also be noted that group 200 of upper yoke laminations is similar to group 166 of lower yoke laminations, shown in FIG. 5.

If the upper yoke laminations are prestacked, such as in an automatic shear line, they are not banded. The pre-stacked bundle would be divided into two halves. The upper half is turned upside down and placed adjacent to the side of the leg members which represents the upper half of their stacks. The lower half of yoke laminations is placed adjacent to the other side of the leg members, without turning it over. The upper yoke is then ready for stacking.

FIG. 9 is a side elevational view of the magnetic core subassembly shown in FIG. 7, after the phase winding assemblies have been positioned on the leg members, with FIG. 9 being viewed from the side of the outer leg member 26. FIG. 9 illustrates the next step of the method wherein the upper yoke is stacked outwardly from the midpoint of the leg members in both directions. The bundles of yoke laminations adjacent each side of the magnetic core are already properly positioned such that the yoke laminations will be assembled with the proper layer of laminations, ensuring that they will all be cut from the same strip material, adjacent to one another in the shearing process. The stacking of the upper yoke may be performed simultaneously by two operators, represented by "eyes" 224 and 226, located on opposite sides of the subassembly. It should be noted that each operator handles a similar group 200 of yoke laminations oriented in the same manner, as far as the operator is concerned, and that each half of the leg laminations adjacent to the operator appears the same to each operator. Thus, the stepped pattern on one side of vertical axis 47 shown in FIG. 9, are in 180° rotational symmetry with the stepped pattern on the other side of axis 47. It should further be noted from FIG. 9 that each operator can see the edges of the steps on the group 200 of yoke laminations, and can thus see into the closing joint, assuring good joint closure and easy checking of the joint. The vertical step-lap joint at the inner leg member permits a quick check of the joint by flipping the ends of the points, which is not possible with the horizontally incremented step-lap joint at the inner leg, because the lower laminations in a horizontal joint are locked in and cannot be "lifted" out to inspect the joint.

After the upper yoke member 32 has been completed, the upper end frames (not shown) are applied to compress th upper yoke laminations and complete the magnetic corewinding subassembly of the electrical inductive apparatus 20. The disclosed method, and magnetic core, facilitate the manufacture of a stacked core having step-lap joints. Manufacturing time is reduced by prestacking the leg members, by stacking the lower yoke laminations with the legs in a horizontal orientation, with the stacking proceeding from one side of the leg members to the other. Further, the step-lap joint between the ends of the leg members and the lower yoke member permit the assembler to see into the closing joint, and to quickly check joint closure, if the integrity of the joint is questioned. Manufacturing time is further reduced by uprighting the core, assembling the phase windings on the upstanding leg members, and assembling the upper yoke member by starting at the midpoint of the leg members and stacking outwardly in opposite directions. The step-lap joint arrangement is such that the joint across each half of magnetic core, when viewed from that side of the core, appears to be the same joint. Thus, the upper yoke is stacked from both sides of the assembly, outwardly, with the assemblers being able to view the closing joints.

When the lower yoke member is being stacked, it is of upmost importance that the operator be able to view the closing joint, as illustrated in FIG. 6. While in a preferred embodiment of the invention, it is also desirable for the operator stacking the upper yoke member to also be able to look into the closing joint, it is not as critical as when the laminations are horizontally oriented. In some instances, it may be desirable to stack the upper yoke laminations such that each group is held captive after it is positioned, by the next leg lamination of the next group. FIGS. 11 and 12 illustrate this embodiment of the invention.

More specifically, FIG. 11 is an elevational view of an outer leg member 26', similar to the view of leg member 26 shown in FIG. 6, except groups 48 of FIG. 2B occupy the lower one half 190 of the stack, and groups 46 of FIG. 2A occupy the upper one half 192 of the stack. Groups 46 and 48 maintain the same orientation in the leg member as in the FIG. 6 embodiment, such that the lower yoke may be assembled with the ends of the steps on the yoke laminations visible to the assembler, to enable the assembler to quickly and accurately close the joints.

FIG. 12 is an end elevational view of leg member 26', similar to the view of FIG. 9. While the assemblers 224 and 226 cannot see into the closing joint, gravity works to properly close the joint in this vertical orientation of the laminations, and each group 200 of upper yoke lmainations is held securely in assembled position by the leg lamination of the next group of leg laminations, in each leg member of the magnetic core.

Figure 14:
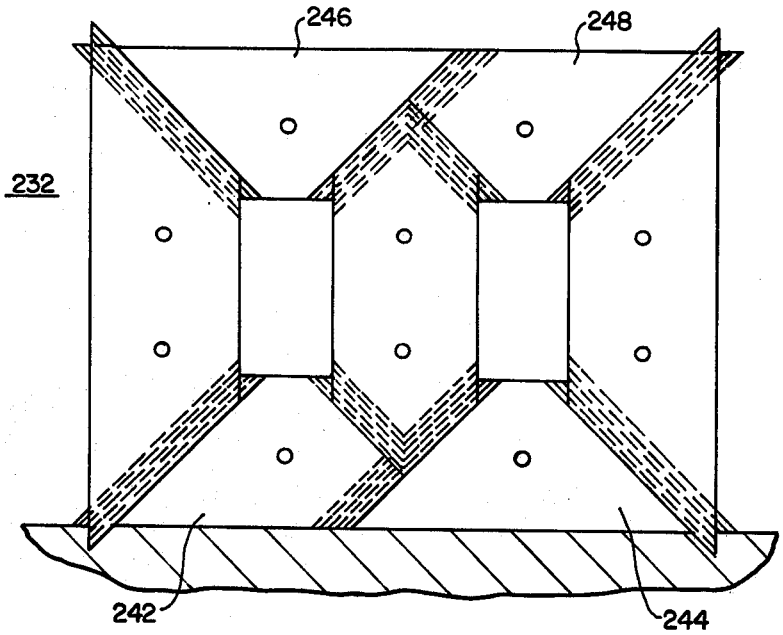
FIG. 14 is an elevational view of another half of a magnetic core having divided yoke members, which is superposed with the half shown in FIG. 13 to provide a composite magnetic core constructed according to the teachings of the invention.
Figure 13:
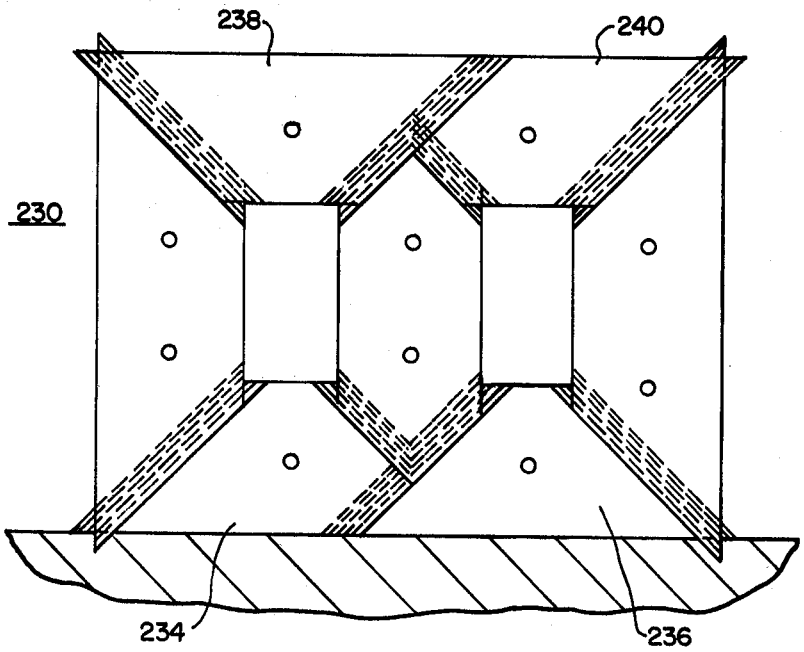
FIG. 13 is an elevational view of one half of a magnetic core having divided yoke members.

In some instances, it is desirable to divide the upper and lower yoke laminations into two separate laminations, such as when the yoke laminations for a specific application become too long to properly handle. FIGS. 13 and 14 are elevational views which illustrate core halves 230 and 232, respectively, which halves are assembled to provide a complete magnetic core. In the preferred embodiment, half 230 represents the lower half, and half 232 represents the upper half, but they may be reversed to provide an embodiment similar to the embodiment of FIGS. 11 and 12. The embodiments of FIGS. 13 and 14 is similar in all respects to the previous embodiments hereinbefore described, except the lower and upper yoke members are each constructed using two laminations per layer. For example, the lower yoke member 34 includes portions 234 and 236 in half 230, and the upper yoke 32 includes portions 238 and 240 and half 230. The lower yoke 34 includes portions 242 and 244 in half 232, and the upper yoke 32 includes portions 246 and 248 in half 232.

We claim as our invention:

1. A magnetic core for electrical inductive apparatus, comprising:

a plurality of superposed layers of metallic, magnetic laminations stacked to a predetermined build dimension to define at least first and second leg members and lower and upper yoke members, each of said layers including at least first and second leg laminations having first and second diagonally cut ends, and lower and upper yoke laminations having diagonally cut ends, with the first and second diagonally cut ends of the first and second leg laminations butting the diagonally cut ends of the lower and upper yoke laminations respectively, to define miter joints, said leg laminations in each of said first and second leg members being arranged in a plurality of first groups in a first one-half of the build dimension, and in a plurality of second groups in the remaining one-half, said leg laminations in each of the first groups having like mean length dimensions, at least certain of the leg laminations in each of the second groups having unlike mean length dimensions, said leg laminations in each of the first and second groups being arranged to offset the joints between at least certain of the layers in each group, in predetermined step-lap patterns.

2. The magnetic core of claim 1 wherein the midpoints of at least certain of the leg laminations in the first groups are incrementally offset from one another to provide the predetermined step-lap patterns between the leg laminations of the first groups and the lower and upper yoke laminations.

3. The magnetic core of claim 1 wherein the midpoints of the leg laminations in the second groups are aligned, to provide the predetermined step-lap patterns between the leg laminations of the second groups and the lower and upper yoke laminations.

4. The magnetic core of claim 1 wherein the predetermined step-lap patterns between the first ends of the leg laminations in each of the first groups and the lower yoke laminations, and between the first ends of the leg laminations in each of the second groups and the lower yoke laminations, are similar in each leg member.

5. The magnetic core of claim 1 wherein the predetermined step-lap patterns between the second ends of the leg laminations of the first groups and the upper yoke laminations are in 180° rotational symmetry with the predetermined step-lap patterns between the second ends of the leg laminations of the second groups and the upper yoke laminations, in each leg member, about the longitudinal axis of each leg member.

6. The magnetic core of claim 1 wherein the predetermined step-lap patterns between the first ends of the leg laminations in each of the first groups and the lower yoke laminations, and between the first ends of the leg laminations in each of the second groups and lower yoke laminations, are similar in each leg member, and wherein the predetermined step-lap patterns between the second ends of the leg laminations of the first groups in the upper yoke laminations are in 180° rotational symmetry with the predetermined step-lap patterns between the second ends of the leg laminations of the second groups and the upper yoke laminations, in each leg member, about the longitudinal axis of each leg member.

7. The magnetic core of claim 1 wherein at least certain of the lower and upper yoke laminations which butt leg laminations in each of the first and second groups, have unlike mean lengths.

8. The magnetic core of claim 1 including an intermediate leg member disposed between the first and second leg members, joined to the lower and upper yoke members with step-lap joints, wherein each layer of laminations includes an intermediate leg lamination having V-shaped first and second ends, and with each of the upper and lower yoke laminations of each layer having V-shaped notches for butting with the first and second V-shaped ends, respectively.

9. The magnetic core of claim 8 wherein the leg laminations of the intermediate leg are arranged in a plurality of first groups in the first one-half of the build dimension, and in a plurality of second groups in the remaining one-half, with the intermediate leg laminations in each of the first groups having like mean length dimensions, and with at least certain of the intermediate leg laminations in each of the second groups having unlike mean length dimensions.

10. A magnetic core for electrical inductive apparatus, comprising:

a plurality of superposed layers of metallic, magnetic laminations stacked to a predetermined build dimension to define first, second and intermediate leg members, and lower and upper yoke members, each of said layers including first, second and intermediate leg laminations, with the first and second leg laminations having first and second diagonally cut ends, the intermediate leg laminations having first and second V-shaped ends, and the lower and upper yoke laminations having diagonally cut ends and V-shaped notches intermediate their ends, with the first and second diagonally cut ends of the first and second leg laminations butting the diagonally cut ends of the lower and upper yoke laminations, respectively, and with the first and second V-shaped ends of the intermediate leg laminations butting the V-shaped notches of the lower and upper yoke laminations, respectively, to define miter joints, said leg laminations in each of said first, second and intermediate leg members being arranged in a plurality of first groups in a first one-half of the build dimension, and in a plurality of second groups in the remaining one-half, said leg laminations in each of the first groups having like mean lengths dimensions, at least certain of the leg laminations in each of the second groups having unlike mean length dimensions, said leg laminations in each of the first and second groups being arranged to offset the joints between at least certain of the layers of each group in predetermined step-lap patterns.

11. The magnetic core of claim 10 wherein the midpoints of at least certain of the laminations in the first groups are incrementally offset from one another to provide the predetermined step-lap patterns between the leg laminations of the first groups and the lower and upper yoke laminations.

12. The magnetic core of claim 10 wherein the midpoints of the leg laminations in the second groups are aligned, to provide the predetermined step-lap patterns between the leg laminations of the second groups and the lower and upper yoke laminations.

13. The magnetic core of claim 10 wherein the predetermined step-lap patterns between the first ends of the leg laminations in each of the first groups and the lower yoke laminations, and between the first ends of the leg laminations in each of the second groups and the lower yoke laminations, are similar in each leg member.

14. The magnetic core of claim 10 wherein the predetermined step-lap patterns between the second ends of the leg laminations of the first groups and the upper yoke laminations are in 180° rotational symmetry with the predetermined step-lap patterns between the second ends of the leg laminations of the second groups in the upper yoke laminations, in each leg member, about the longitudinal axis of each leg member.

15. The magnetic core of claim 10 wherein the step-lap patterns between the first and second ends of the intermediate leg member and the upper and lower yoke members is a vertical step-lap pattern wherein the V-shaped joints are incrementally offset from one another along the longitudinal axis of the intermediate leg member.

16. The magnetic core of claim 10 wherein at least certain of the lower and upper yoke laminations which butt leg laminations in each of the first and second groups have unlike mean lengths.

* * * * *